US009279309B2

(12) United States Patent
Werswick et al.

(10) Patent No.: US 9,279,309 B2
(45) Date of Patent: Mar. 8, 2016

(54) VALVE ARRANGEMENT FOR A PRODUCTION PIPE

(75) Inventors: Bjørnar Werswick, Langesund (NO); Haavard Aakre, Skien (NO); Vidar Matheisen, Porsgrunn (NO)

(73) Assignee: STATOIL PETROLEUM AS, Stavanger (NO)

( * ) Notice: Subject to any disclaimer, the term of this patent is extended or adjusted under 35 U.S.C. 154(b) by 297 days.

(21) Appl. No.: 13/978,862

(22) PCT Filed: Jan. 10, 2011

(86) PCT No.: PCT/EP2011/050224
§ 371 (c)(1),
(2), (4) Date: Sep. 23, 2013

(87) PCT Pub. No.: WO2012/095166
PCT Pub. Date: Jul. 9, 2012

(65) Prior Publication Data
US 2014/0008079 A1 Jan. 9, 2014

(51) Int. Cl.

| | |
|---|---|
| ***E21B 43/12*** | (2006.01) |
| ***E21B 34/08*** | (2006.01) |
| ***E21B 43/32*** | (2006.01) |
| ***E21B 17/18*** | (2006.01) |

(52) U.S. Cl.
CPC ..... *E21B 34/08* (2013.01); *E21B 17/18* (2013.01); *E21B 43/12* (2013.01); *E21B 43/32* (2013.01)

(58) Field of Classification Search
CPC ..... E21B 34/08; E21B 43/08
See application file for complete search history.

(56) References Cited

U.S. PATENT DOCUMENTS

| | | | | |
|---|---|---|---|---|
| 8,291,985 | B2 * | 10/2012 | Holderman | 166/376 |
| 2006/0118296 | A1 | 6/2006 | Dybevik et al. | |
| 2009/0101354 | A1 | 4/2009 | Holmes et al. | |
| 2009/0133869 | A1 | 5/2009 | Clem | |
| 2009/0218103 | A1 * | 9/2009 | Aakre et al. | 166/373 |
| 2014/0014337 | A1 * | 1/2014 | Stringfield et al. | 166/278 |

FOREIGN PATENT DOCUMENTS

| | | | |
|---|---|---|---|
| NO | 314701 | B1 | 5/2003 |
| WO | WO 2009/103036 | A1 | 8/2009 |
| WO | WO 2009/123472 | A2 | 10/2009 |

* cited by examiner

*Primary Examiner* — William P Neuder
(74) *Attorney, Agent, or Firm* — Birch, Stewart, Kolasch & Birch, LLP

(57) ABSTRACT

A tubular member has at least one drainage section including an inlet inlet and at least one self-adjustable flow control device to control the flow of fluid into the drainage section from a well. The flow control devices are located in an annular space surrounding a pipe between the inlet and an outlet is provided for fluid flowing into the drainage section. The annular space forms a flow path through the flow control device passing by a valve body arranged to adjust the flow area in response to the pressure difference across the flow control device and/or changes in density of the fluid. The flow control device includes a valve seat cooperating with the valve body. The valve body includes an annular resilient valve member arranged to be deformed at least in a radial direction, in order to reduce or increase the flow area through the flow control device.

25 Claims, 6 Drawing Sheets

VALVE ARRANGEMENT FOR A PRODUCTION PIPE

TECHNICAL FIELD

The present invention relates to an inflow control device for providing constant mass flow of hydrocarbons into a production line in a wellbore.

BACKGROUND ART

A static, fixed inflow control device (ICD) is used in horizontal wells to control the inflow of hydrocarbons to a production line in wellbores. Horizontal wells are characterized by having an uneven drainage profile from the heel to the toe. Due to the varying pressure drops along a horizontal well, the heel of a horizontal well tends to be drained much faster than the toe. Once the reservoir surrounding the heel portion of the well has been substantially drained, water breakthrough may be experienced. Water breakthrough near the heel portion of the well will occur long before the toe portion of the well is drained, resulting in a poor total yield of hydrocarbons from the well. ICDs are arranged along the horizontal well in order to even out the drainage rate along the well in an attempt to provide a more even drainage profile along the well. The ICDs near the heel tend to have much smaller and fewer openings than the ICDs closer to the toe, thereby providing a more even drainage profile along the entire horizontal well.

An example of a static inflow control device is shown in NO 314701, which discloses a flow arrangement for use in a well through an underground reservoir. The arrangement is designed to throttle radially inflowing reservoir fluids produced through an inflow portion of the production tubing in the well. Such an arrangement is designed to effect a relatively stable and predictable fluid pressure drop at any stable fluid flow rate in the course of the production period of the well, and where said fluid pressure drop will exhibit the smallest possible degree of susceptibility to influence by differences in the viscosity and/or any changes in the viscosity of the inflowing reservoir fluids during the production period. Such a fluid pressure drop is obtained by the arrangement comprising among other things one or more short, removable and replaceable flow restrictions such as nozzle inserts, and where the individual flow restriction may be given the desired cross section of flow, through which reservoir fluids may flow and be throttled, or the flow restriction may be a sealing plug.

While static ICDs can be selected and installed with more or less correct inflow control properties at the beginning of the production life time of the well, the properties of the well will change over time in a manner that is difficult or impossible to foresee and account for when installing the ICDs during initial completing of the well. Since the ICDs are static, there is no easy way to adjust the inflow characteristics of the ICDs after the initial installment. The result is that the drainage characteristics that were correct and optimal during the first part of the production lifetime, becomes more and more off as time as the well starts to mature.

Another drawback with conventional fixed opening ICDs is that while the openings produce a pressure drop that may retard the inflow of hydrocarbons, thereby provide a more even drainage profile along the well from the toe to the heel and delaying the onset of water or gas breakthrough, the conventional ICDs have no ability to close of their openings in the event of water or gas breakthrough.

The object of the invention is therefore to provide an improved solution that solves the above problems and is more reliable in terms of functionality. These objects and others will become apparent from the following description.

DISCLOSURE OF INVENTION

The above problems are solved by a tubular member provided with a flow control device according to the appended claims.

The present invention relates to an improved, alternative solution to the above mentioned autonomous valve, also utilizing the Bernoulli effect to provide an autonomous, self-adjusting inflow control device (ICD) that is able to automatically adjust the flow of fluid depending on flow velocity, pressure and/or the composition of the fluid and its properties (density, etc.), and limit or eliminate production of water or gas in an oil well in the event of water or gas break-through.

According to one embodiment, the invention relates to a tubular member having at least one drainage section comprising at least one inlet or aperture, and at least one self-adjustable flow control device to control the flow of fluid into the drainage section from a well formed in a subterranean reservoir. The invention also relates to a flow control device arranged to be mounted in such a tubular member. Each of the flow control devices are located in an annular space surrounding a base pipe in the tubular member between said inlet or aperture and at least one outlet for fluid flowing into the drainage section.

The annular space can be formed as an external housing encircling a base pipe of the tubular member and extending a predetermined axial distance along the said base pipe. The fluid can be admitted to the annular space through an annular inlet or a number of axial or radial holes through the outer surface of the housing. Inlets are commonly protected by sand screens to prevent sand or debris from entering the drainage section. A sand screen can in itself also be used as an inlet. The outlet connecting the annular space with inner volume of the tubular member can comprise at least one radial hole in the tubular member. The radial holes are located downstream of the flow control device and can for instance be located equispaced around the circumference of the base pipe. In this context, the term equispaced is used to denote holes spaced at equal distances from each other around said circumference. The annular space forms a flow path through the flow control device passing by a valve body arranged to reduce or increase the flow area of the flow control device in response to the pressure difference across the flow control device and/or changes in density of the fluid, as stated above.

Although the drainage section can comprise multiple self-adjustable flow control device, only one such valve will be described in the subsequent text.

The flow control device comprises a valve seat cooperating with the valve body, which valve body comprises an annular resilient valve member arranged to be deformed at least in a radial direction, in order to reduce or increase the flow area through the flow control device. The annular resilient valve member is arranged to be deformed by the flowing fluid to decrease the flow area through the flow control device in response to an increased pressure difference across the flow control device and/or a changes in density deviating from that of the fluid to be extracted. The annular resilient valve member is in contact with a bevelled surface on the valve seat, which bevelled surface is arranged at an angle extending towards at least one exit opening in the flow control device in the direction of fluid flow. Depending on the desired deformation of the annular resilient valve member this angle may be selected within the range 30° to 60°, for instance 45°.

The annular resilient valve member is arranged to be deformed against the valve seat and displaced at least in a radial direction towards the at least one exit opening in the flow control device (10), thereby decreasing the flow area.

According to a first alternative embodiment, the annular resilient valve member and the valve seat are arranged to extend around the tubular member within the annular space. The valve seat can be positioned around the inner diameter of the annular space, which valve seat is arranged to limit the axial displacement of the annular resilient valve member. The annular resilient valve member is arranged to be forced against the valve seat and be deformed at least in a radial direction towards, or into contact with the outer diameter of the annular space. In this case, the flow control device and its valve seat can be fixed to or releasably clamped around the base pipe prior to the mounting of an outer coaxial housing. Alternatively, the tubular member is supplied as a unit and a base pipe section with an integrated flow control device is welded to adjacent pipe sections at either end.

In a further example, the valve seat can be positioned around the outer diameter of the annular space, which valve seat is arranged to limit the axial displacement of the annular resilient valve member. The annular resilient valve member is arranged to be forced against the valve seat and be deformed at least in a radial direction towards, or into contact with the inner diameter of the annular space. In this case, the flow control device and its valve seat can be fixed to or releasably clamped into the outer coaxial housing prior to the mounting of the housing around the base pipe. Alternatively, the tubular member is supplied as a unit and a base pipe section with an integrated flow control device is welded to adjacent pipe sections at either end.

The flow control device is arranged to extend between the inner and outer diameters of the annular space, to form a radial wall with openings for flowing fluid. Fluid is arranged to flow past the annular resilient valve member through spaced arcuate gaps in the outer or inner periphery of the flow control device, depending on the location of the valve seat. These arcuate gaps between the flow control device and the outer or inner wall of the annular space are preferably, but not necessarily equispaced.

According to a second alternative embodiment, at least one annular resilient valve member and valve seat are arranged in a corresponding number of openings in a radial wall extending between the inner and outer diameters of the annular space. The openings can comprise equispaced axial holes through the radial wall. The holes can be located on the same radial distance or on different radial distances from the central axis of the tubular member.

The annular resilient valve member is arranged to be forced against the valve seat, which is located on the upstream side of the opening, and be deformed at least in a radial direction inwards. As the annular resilient valve member is deformed towards the central portion of the opening, fluid flow through the said openings in a radial wall can be decreased or prevented flow.

In order to achieve the desired deformation of the annular resilient valve member, its properties, such as material composition, size (diameter and cross-sectional area/shape) and resistance to degradation, is preferably selected for each individual case. The selection criteria can be determined by the properties of the fluid to be extracted, extraction depth and which non-desired fluids may be encountered in the well.

As stated above, the annular space is arranged between a base pipe and a coaxial housing surrounding the base pipe. The annular space can be provided with one or more axially spaced flow control devices between the said inlet and the said outlet. The advantage of using multiple, for instance two, flow control devices is that the properties of the two (or more) annular resilient valve member may chosen to be different on order to obtain desired flow-through characteristics. According to one example, the deforming properties of each of the resilient material elements may be chosen to cover different viscosity ranges of the fluid to be extracted. According to another example, one of the elements may be a swelling material that swells when it comes in contact with water, gas or some other compound from the well.

The invention also relates to a method for automatically adjusting the flow through a self-adjustable flow control device for controlling the flow of fluid into a drainage section from a well formed in a subterranean reservoir into a production pipe. As described above, the flow control device is located in an annular space surrounding a tubular member of the production pipe between an inlet or aperture and at least one outlet for fluid flowing into the drainage section. The annular space forms a flow path through the flow control device passing by a valve body arranged to reduce or increase the flow area of the flow control device in response to the pressure difference across the flow control device and/or changes in density of the fluid.

According to the method, fluid flowing through the flow control device forms a flow path passing the valve body, which valve body comprises an annular resilient valve member. The fluid acts on the valve body, deforming the annular resilient valve member and causing a reduction or increase of the flow area through the flow control device. The fluid flow forces the annular resilient valve member into contact with a bevelled surface on a valve seat, wherein the annular resilient valve member is deformed and directed in at least a radial direction to restrict the flow through the flow control device.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1B:
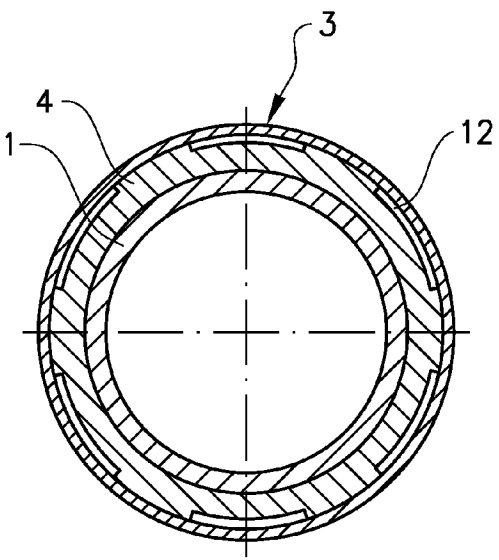
FIG. 1B shows a cross-section of the embodiment in FIG. 1A in the plane A-A.
Figure 1A:
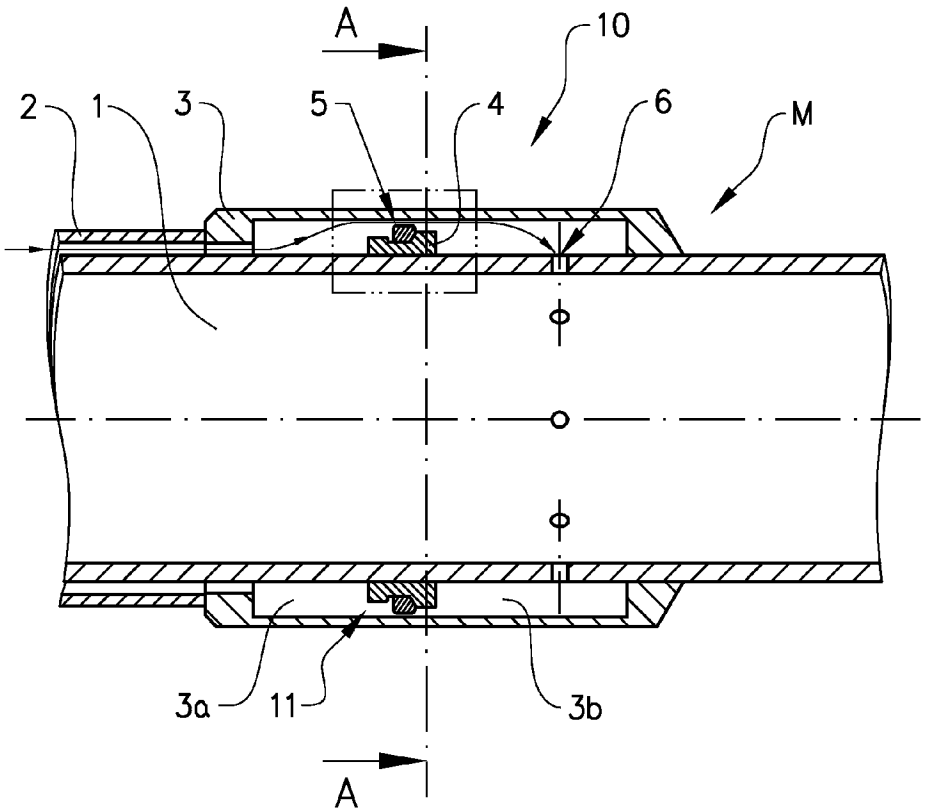
FIG. 1A shows a part of a tubular member provided with a flow control device according to a first embodiment of the invention.

FIG. 1A shows a part of a tubular member M provided with a flow control device 10 according to a first embodiment of the invention. A base pipe 1 arranged through a production zone is provided with a sand screen 2 which acts as an inlet. The sand screen 2 is a mesh encircling the base pipe 1 intended to filter out sand and particles while admitting through production fluid. The production fluid flows from the inlet into a first annular chamber 3*a* of an annular housing 3 surrounding the base pipe 1. The fluid then passes a flow control device 10 in the form of an inflow control device (ICD). The ICD comprises a valve seat 4 and an annular resilient valve member 5 in the form of an O-ring or a similar sealing means. The valve seat 4 comprises a ring mounted around the outer circumference of the base pipe 1, which ring is provided with a groove that accommodates and locates the annular resilient valve member 5. The side of the groove located downstream of the annular resilient valve member 5 is a valve seat contact surface angled in a direction radially outwards and downstream. The contact surface for the valve seat shown in FIG. 1A is angled approximately 60° from the central axis of the base pipe 1. The annular resilient valve member 5 is disposed in the groove of the valve seat 4 so that it provides an annular gap between the annular resilient valve member 5 and the inner surface of the annular housing 3. This annular gap provides a passage for the production fluid flowing from the inlet to a number of outlets 6 into the base pipe 1. According to the embodiment shown in FIG. 1A, the production fluid flows past the flow control device 10 and into a second annular chamber 3*b* before entering the base pipe 1 through radial openings 6 in the base pipe 1. The gap between the annular resilient valve member 5 and the inside of the annular housing 3 defines a flow area. The resilient material is chosen according to its desired deformation properties.

When the production fluid passes over the valve seat 4 and the annular resilient valve member 5, the Bernoulli effect will result in a pulling force from the fluid acting on the annular resilient valve member 5. The pulling force increases with increasing flow velocity of the production fluid. When sufficiently large, this pulling force results in a deformation of the O-ring making up the annular resilient valve member 5, as it is forced against the contact surface on the valve seat 4. The deformation causes the O-ring to expand radially outwards, which narrows or closes the gap between the O-ring and the inside of the annular housing 3. This also reduces the net flow area for the production fluid.

If the viscosity of the production fluid decreases, the Bernoulli effect dictates that pulling force increases further, thereby narrowing the gap between the O-ring and the inside of the annular housing 3 further. On the other hand, if the viscosity of the production fluid increases, the Bernoulli effect dictates that pulling force decreases, thereby increasing the gap between the O-ring and the inside of the annular housing 3. In the latter case, the flow area will increase, thereby permitting an increased mass flow rate of the production fluid. If the production fluid is oil, the deforming properties of the annular resilient valve member 5 can be chosen such that the gap remains open while oil is produced. If a water break-through occurs, i.e. a significant amount of water is enters the inlet together with the oil, the deforming properties of the annular resilient valve member 5 should be chosen such that the gap will decrease due to the decreased viscosity of the fluid passing through the gap.

FIG. 1B shows a cross-section of the embodiment in FIG. 1A in the plane A-A, at right angles to the central axis of the base pipe. In this figure, the annular gap between the O-ring and annular housing 3 is arranged as a number of arcuate segments 12. The arcuate segments 12 can have a predetermined radial and circumferential extension selected dependent on the flow rate through the flow control device. It is understood that the number of arcuate segments 12 can be chosen according to preference or need, e.g. for supporting a deformed O-ring between the open segments. In the case that the gap is segmented, it is also possible to segment the annular resilient valve member 5, i.e. arrange a number of resilient material sections that correspond to the number of arcuate segments. It is also possible have a continuous annular gap that is not segmented.

Figure 1C:
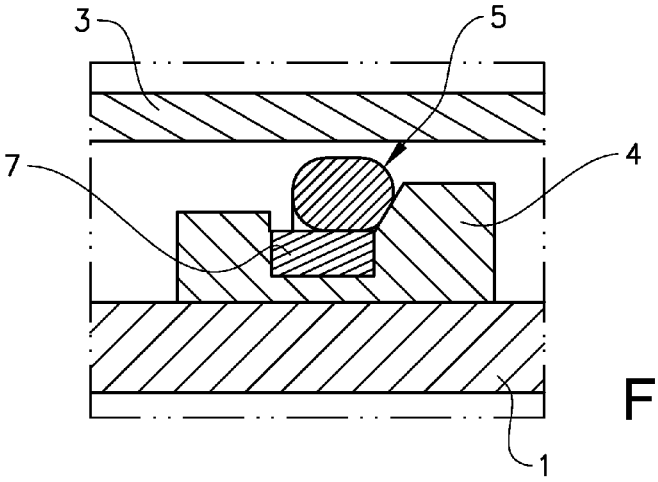
FIG. 1C shows an enlarged view of a part of FIG. 1A.

FIG. 1C an enlarged view of a part of FIG. 1A. As shown in FIG. 1A, the tubular member comprises a section of the annular housing 3, base pipe 1, a valve seat 4 and an annular resilient valve member 5 in the form of an O-ring. An annular gap is created between the annular resilient valve member 5 and the inner surface of the annular housing 3. The size of the gap varies depending on the velocity and/or viscosity of the production fluid which passes between the O-ring and annular housing 3. The valve member 5 can be assisted by an additional sealing means 7 comprising a swellable material susceptible to an undesirable fluid, such as water, flowing into the valve. Depending on the prevailing conditions, the flow control device can be closed by the valve member 5 an/or by the swellable sealing means 7.

Figure 1D:
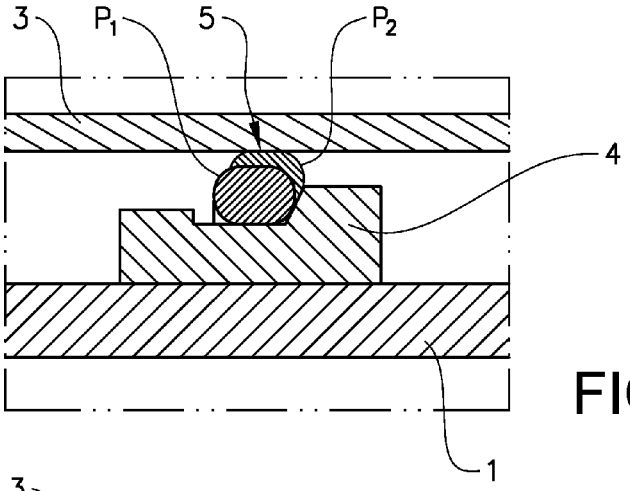
FIG. 1D shows the function of a valve according to the first embodiment of the invention.

FIG. 1D shows the function of a valve with an annular resilient valve member 5 in the form of an O-ring, according to the first embodiment of the invention. In this embodiment, the valve seat 4 is attached to the base pipe. FIG. 1D shows the annular resilient valve member 5 in two positions, where a first position $P_1$ is indicated by a solid cross-section corresponding to an undeformed or mainly undeformed O-ring. A second position $P_2$ is indicated by a hatched cross-section corresponding to a deformed O-ring. In the second position, the O-ring contacts the inner surface of the coaxial annular housing 3 and closes the valve. The deformation is a result of a high fluid flow velocity of a low-viscosity fluid passing through the gap. If the fluid velocity is sufficiently high, the viscosity is sufficiently low, and the deformation properties of the O-ring permitting, the gap can close entirely or almost entirely. In this way, undesirable fluids such as water can be prevented from entering the base pipe.

Figure 1E:
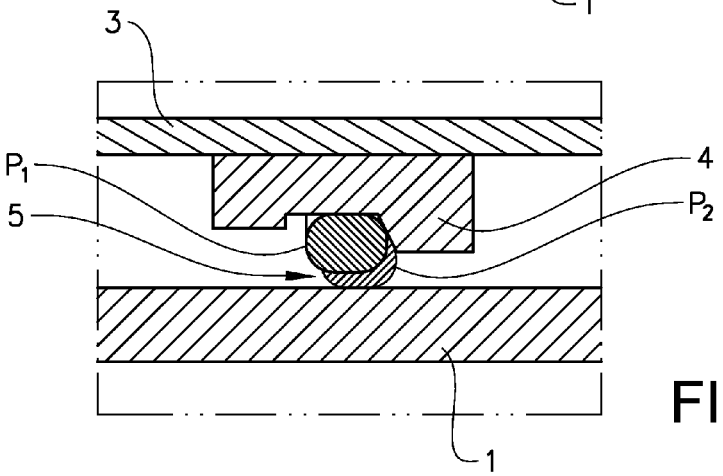
FIG. 1E shows the function of a valve according to an alternative first embodiment of the invention.

FIG. 1E shows the function of a valve with an annular resilient valve member 5, according to an alternative first embodiment of the invention. In this embodiment, the valve seat 4 is attached to the inner surface of the coaxial annular housing 3. FIG. 1E shows the annular resilient valve member 5 in two positions, where a first position $P_1$ is indicated by a solid cross-section corresponding to an undeformed or mainly undeformed O-ring. A second position $P_2$ is indicated by a hatched cross-section corresponding to a deformed O-ring. In the second position, the O-ring contacts the outer surface of the base pipe 1 and closes the valve.

In the subsequent figures, component parts which are identical, or substantially identical, will be indicated using the same reference numerals as in FIGS. 1A-E.

Figure 2:
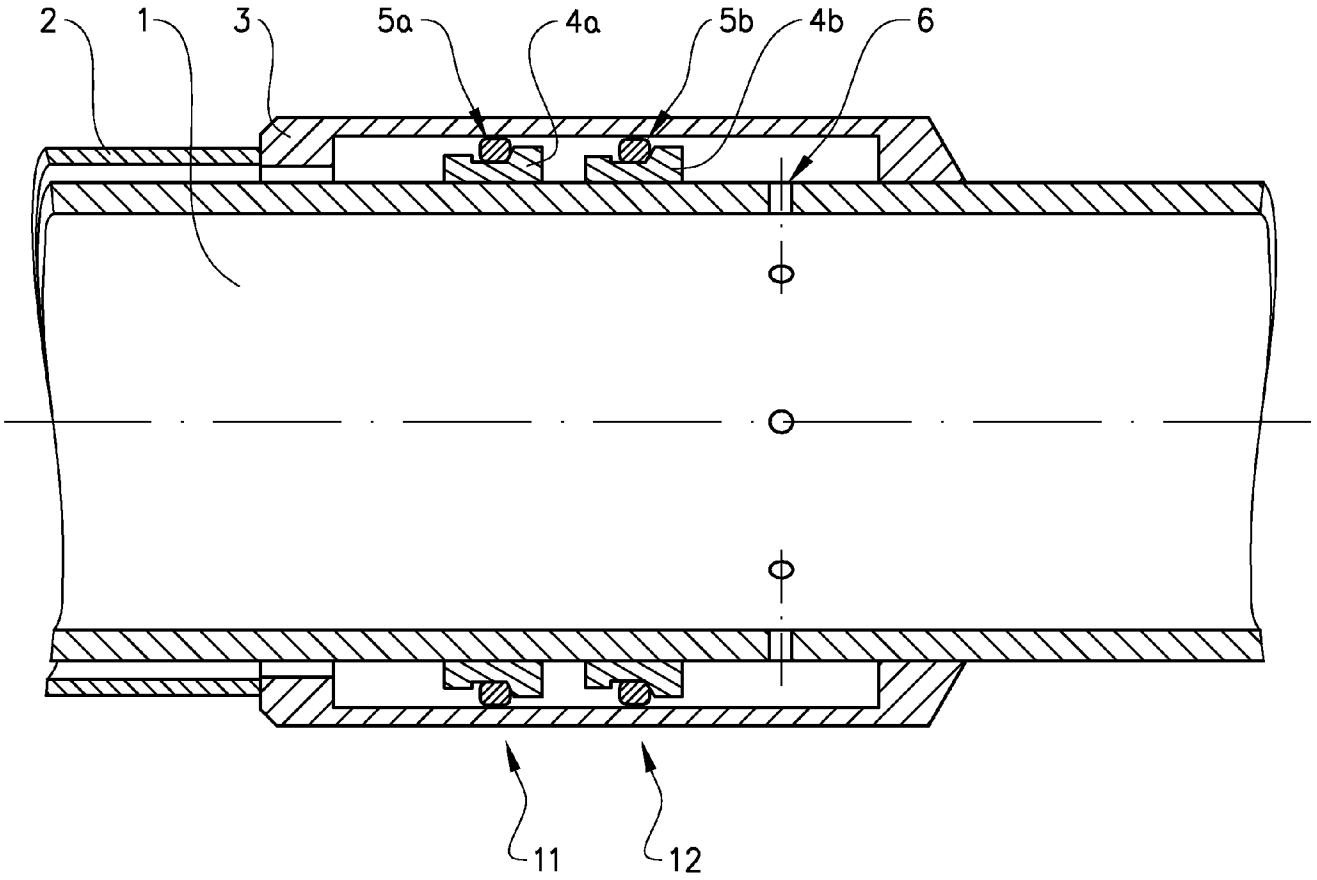
FIG. 2 shows an alternative version of the embodiment of FIG. 1A.

FIG. 2 shows an alternative version of the embodiment of FIG. 1A. In this example the tubular member is provided with two axially separated flow control devices 11, 12 of the type described above. The properties of the two annular resilient valve members 5*a*, 5*b* shown can be chosen to be different on order to obtain desired flow-through characteristics. The valve seats 4*a*, 4*b* can be identical or individually adapted, depending on the choice of material corresponding valve member. According to one example, the deforming properties of each of the annular resilient valve members 5*a*, 5*b* can be chosen to cover different viscosity ranges. This is achieved by selecting a pair of O-rings where one is softer than the other, whereby deformation will occur at different flow velocities and/or fluid densities for the two flow control devices. In another example, one of the flow control devices 11, 12 can have the annular resilient valve members replaced by an annular member made from a material that swells when it comes in contact with water, gas or some other compound, whereby the fluid flow is restricted or closed.

Figure 3B:
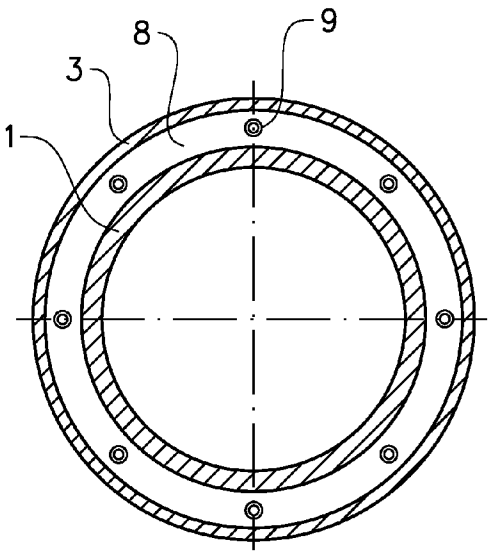
FIG. 3B shows a cross-section of the embodiment in FIG. 3A in the plane B-B.
Figure 3A:
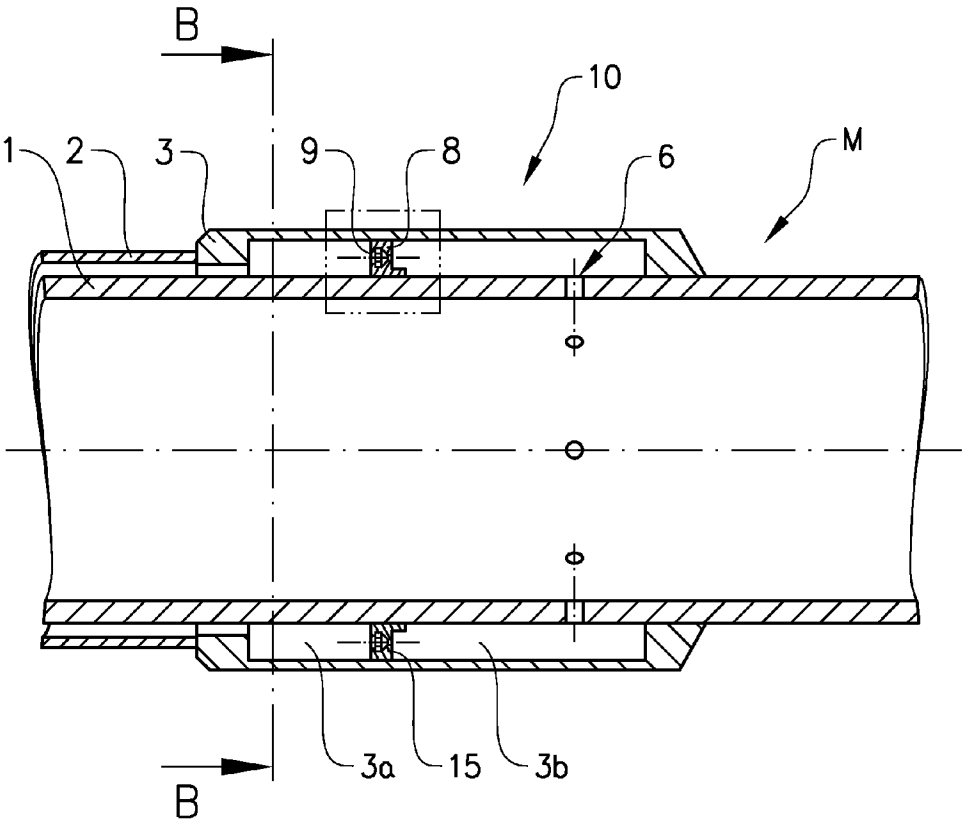
FIG. 3A shows a part of a tubular member provided with a flow control device according to a second embodiment of the invention.
Figure 3C:
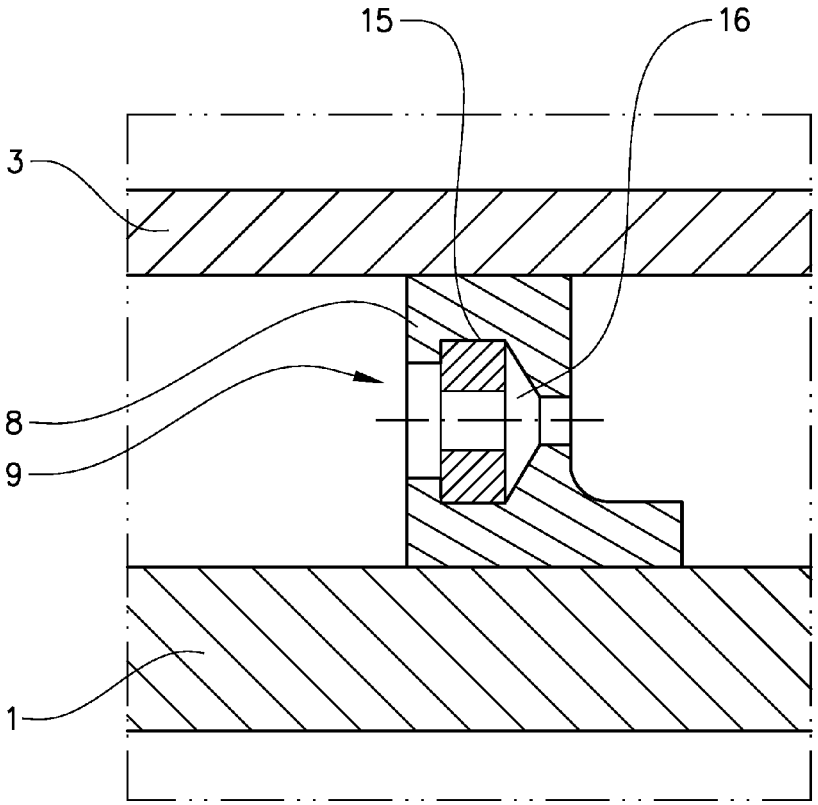
FIG. 3C shows an enlarged view of the flow contral device shown in FIG. 3A.

FIG. 3A shows a part of a tubular member provided with a flow control device according to a second embodiment of the invention. This flow control device is provided with an annular, radial wall 8 extending from the base pipe to the inner surface of the housing 3. The radial wall 8 is provided with a suitable number of apertures or nozzles 9 through which the production fluid is allowed to flow. An enlarged view of the flow control device is shown in FIG. 3C. At least one and preferably all of the apertures arranged to act as valve seats 16, wherein a contact surface having the general shape of a truncated cone with its apex directed downstream is provided in each aperture 9. A radial groove is provided in each opening adjacent the contact surface. The radial groove is arranged to locate an annular resilient valve member 16 which is arranged to be deformed to open or close depending on the velocity and/or viscosity of the production fluid flowing through the annular resilient valve member 16. In principle, the opening and closing of the ring is determined by the same factors as described above in relation to the embodiment of FIGS. 1A-1E. As in those embodiments, the annular resilient valve members 16 can comprise a ring-shaped body with a rectangular, circular or other suitable cross-section.

The material of the ring-shaped body and/or the number of axially separated flow control device can be selected in the same way as described for FIGS. 1A-1E and FIG. 2 above.

FIG. 3B shows a cross-section of the embodiment in FIG. 3A in a plane B-B at right angles to the central axis of the base pipe. This figure shows the flow controlling apertures 9 arranged in the radial wall 8. In the example shown, the apertures 9 are located equispaced and at the same radius from the central axis of the base pipe 1.

Figure 4:
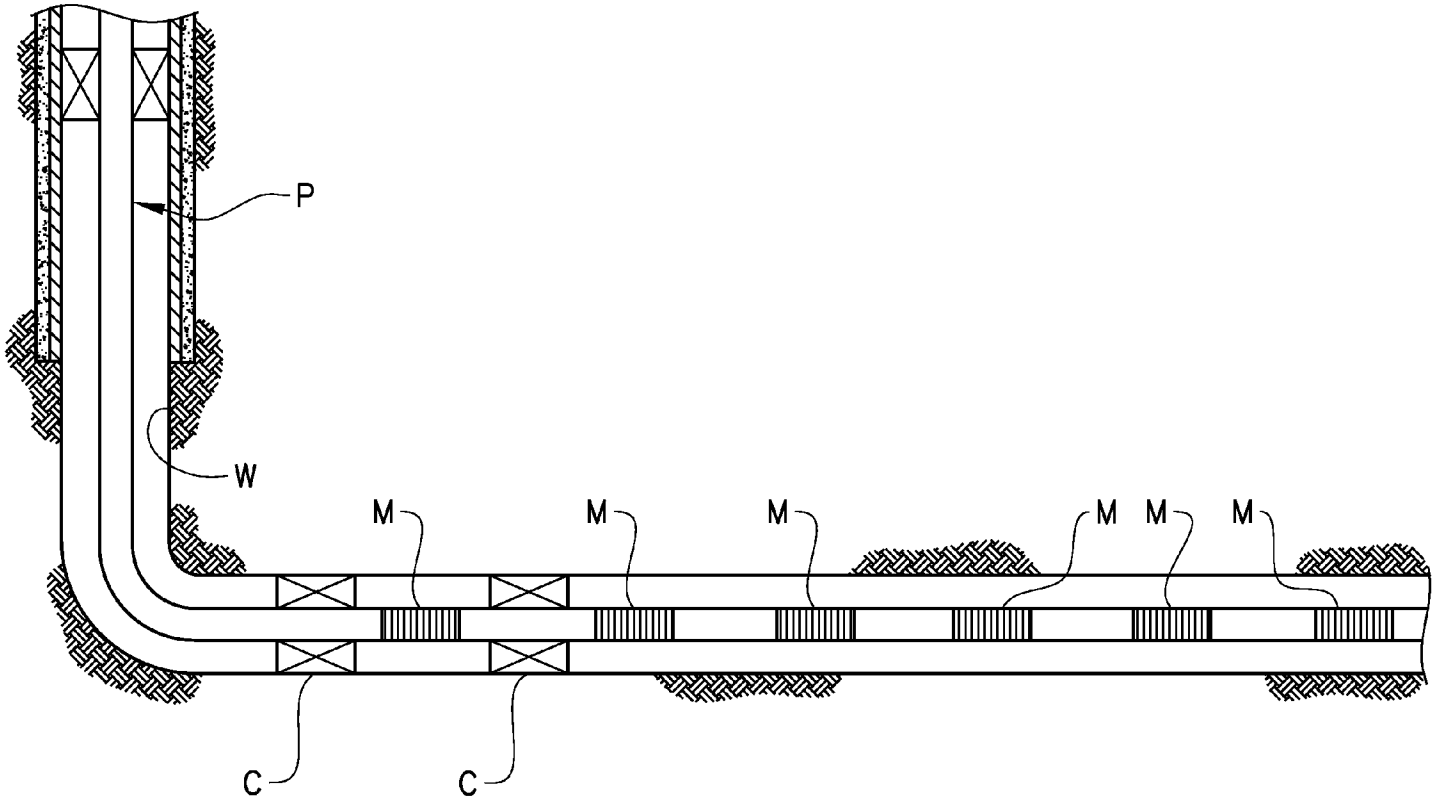
FIG. 4 shows a production line comprising tubular members with flow control devices according to the invention.

FIG. 4 shows a production line P comprising multiple tubular members M with flow control devices according to the invention. The production line P is placed in a well W where it is localized by a number of centralizers surrounding the production line P.

The invention claimed is:

1. A tubular member having at least one drainage section comprising at least one inlet or aperture and at least one self-adjustable flow control device to control the flow of fluid into the drainage section from a well formed in a subterranean reservoir, wherein each of the flow control devices are located in an annular space surrounding a base pipe, said annular space being between said inlet or aperture and at least one outlet provided for fluid flowing into the base pipe, said annular space forming a flow path through the flow control device passing by a valve body arranged to reduce or increase the flow area of the flow control device in response to the pressure difference across the flow control device and/or changes in density of the fluid, wherein the flow control device comprises a valve seat cooperating with the valve body, which valve body comprises an annular resilient valve member arranged to be deformed at least in a radial direction in response to the pressure difference across the flow control device and/or changes in a density of the fluid, in order to reduce or increase the flow area through the flow control device.

2. The tubular member according to claim 1, wherein the annular resilient valve member is arranged to be deformed by the flowing fluid to decrease the flow area through the flow control device in response to an increased pressure difference across the flow control device and/or a changes in density deviating from that of the fluid to be extracted.

3. The tubular member according to claim 1, wherein the annular resilient valve member is in contact with a bevelled surface on the valve seat, which bevelled surface is arranged at an angle extending towards at least one exit opening in the flow control device in the direction of fluid flow.

4. The tubular member according to claim 3, wherein the annular resilient valve member is arranged to be deformed against the valve seat and displaced at least in a radial direction towards the at least one exit opening in the flow control device, thereby decreasing the flow area.

5. The tubular member according to claim 1, wherein the annular resilient valve member and the valve seat are arranged to extend around the base pipe within the annular space.

6. The tubular member according to claim 5, wherein the valve seat is positioned around the inner diameter of the annular space, which valve seat is arranged to limit the axial displacement of the annular resilient valve member.

7. The tubular member according to claim 6, wherein the annular resilient valve member is arranged to be forced against the valve seat and be deformed at least in a radial direction towards, or into contact with the outer diameter of the annular space.

8. The tubular member according to claim 5, wherein the valve seat is positioned around the outer diameter of the annular space, which valve seat is arranged to limit the axial displacement of the annular resilient valve member.

9. The tubular member according to claim 8, wherein the annular resilient valve member is arranged to be forced against the valve seat and be deformed at least in a radial direction towards, or into contact with the inner diameter of the annular space.

10. The tubular member according to claim 5, wherein the flow control device is arranged to extend between the inner and outer diameters of the annular space, and that fluid is arranged to flow past the annular resilient valve member through spaced arcuate gaps around the periphery of the flow control device.

11. The tubular member according to claim 1, wherein at least one annular resilient valve member and valve seat are arranged in a corresponding number of openings in a radial wall extending between the inner and outer diameters of the annular space.

12. The tubular member according to claim 11, wherein the annular resilient valve member is arranged to be forced against the valve seat and be deformed at least in a radial direction inwards, in order to decrease or prevent flow through the said openings in the radial wall.

13. The tubular member according to claim 1, wherein the annular space is arranged between the base pipe and a coaxial housing surrounding the base pipe.

14. The tubular member according to claim 1, wherein the annular space is provided with one or more flow control devices between the said inlet and the said outlet.

15. A self-adjustable flow control device arranged to control the flow of fluid into a drainage section from a well formed in a subterranean reservoir, wherein the flow control device is located in an annular space surrounding a base pipe, said annular space being between an inlet or aperture and at least one outlet for fluid flowing into the drainage section, said annular space forming a flow path through the flow control device, said flow control device comprising a valve body arranged to reduce or increase the flow area of the flow control device in response to the pressure difference across the flow control device and/or changes in density of the fluid, wherein the flow control device comprises a valve seat cooperating with the valve body, which valve body comprises an annular resilient valve member arranged to be deformed at least in a radial direction in response to the pressure difference across the flow control device and/or changes in density of the fluid, in order to reduce or increase the flow area through the flow control device.

16. The self-adjustable flow control device according to claim 15, wherein the annular resilient valve member and the valve seat are arranged to extend around the base pipe within the annular space.

17. The self-adjustable flow control device according to claim 16, wherein the valve seat is positioned around the inner diameter of the annular space, which valve seat is arranged to limit the axial displacement of the annular resilient valve member.

18. The self-adjustable flow control device according to claim 17, wherein the annular resilient valve member is arranged to be forced against the valve seat and be deformed at least in a radial direction towards, or into contact with the outer diameter of the annular space.

19. The self-adjustable flow control device according to claim 16, wherein the valve seat is positioned around the outer diameter of the annular space, which valve seat is arranged to limit the axial displacement of the annular resilient valve member.

20. The self-adjustable flow control device according to claim 19, wherein the annular resilient valve member is arranged to be forced against the valve seat and be deformed at least in a radial direction towards, or into contact with the inner diameter of the annular space.

21. The self-adjustable flow control device according to claim 16, wherein the flow control device is arranged to extend between the inner and outer diameters of the annular space, and that fluid is arranged to flow past the annular resilient valve member through spaced arcuate gaps around the periphery of the flow control device.

22. The self-adjustable flow control device according to claim 15, wherein at least one annular resilient valve member and valve seat are arranged in a corresponding number of openings in a radial wall extending between the inner and outer diameters of the annular space.

23. The self-adjustable flow control device according to claim 22, wherein the annular resilient valve member is arranged to be forced against the valve seat and be deformed at least in a radial direction inwards, in order to decrease or prevent flow through the said openings in the radial wall.

24. A method for automatically adjusting the flow through a self-adjustable flow control device for controlling the flow of fluid into a drainage section from a well formed in a subterranean reservoir into a production pipe, the method comprising:

locating the flow control device in an annular space surrounding a tubular member of the production pipe, said annular space being between an inlet or aperture and at least one outlet for fluid flowing into the production pipe, said annular space forming a flow path through the flow control device passing by at least one valve body arranged to reduce or increase the flow area of the flow control device in response to the pressure difference across the flow control device and/or changes in density of the fluid, wherein fluid flowing through the flow control device forms a flow path passing the valve body, which valve body comprises an annular resilient valve member, and wherein the fluid acts on the valve body to deform the annular resilient valve member causing a reduction or increase of the flow area through the flow control device in response to the pressure difference across the flow control device and/or changes in density of the fluid.

25. The method according to claim 24, wherein the fluid flow forces the annular resilient valve member into contact with a bevelled surface on a valve seat, wherein the annular resilient valve member is deformed and directed in at least a radial direction to restrict the flow through the flow control device.

* * * * *